US007954188B2

(12) United States Patent
House et al.

(10) Patent No.: US 7,954,188 B2
(45) Date of Patent: Jun. 7, 2011

(54) FURNITURE ATTACHMENT SYSTEM AND METHODS OF USE

(76) Inventors: Steven C. House, Elizabeth, CO (US); Jennie House, Elizabeth, CO (US)

( * ) Notice: Subject to any disclaimer, the term of this patent is extended or adjusted under 35 U.S.C. 154(b) by 242 days.

(21) Appl. No.: 12/027,380

(22) Filed: Feb. 7, 2008

(65) Prior Publication Data

US 2009/0199338 A1 Aug. 13, 2009

(51) Int. Cl.
*A47C 21/00* (2006.01)

(52) U.S. Cl. ..... 5/503.1; 5/922; 383/7; 211/64

(58) Field of Classification Search ..... 5/503.1, 5/922; 383/7; 248/441.1; 211/28, 64, 119.006
See application file for complete search history.

(56) References Cited

U.S. PATENT DOCUMENTS

| | | | | |
|---|---|---|---|---|
| 2,557,674 | A | 9/1949 | McRae | |
| 4,104,751 | A | 8/1978 | Churchman | |
| 4,129,909 | A | 12/1978 | Riehl | |
| 4,461,442 | A | 7/1984 | Keenan | |
| 4,483,501 | A | 11/1984 | Eddy | |
| 4,521,930 | A | 6/1985 | Henson | |
| 4,788,838 | A | 12/1988 | Cislo | |
| 5,581,829 | A | 12/1996 | Lee | |
| 5,605,235 | A | 2/1997 | Johnson | |
| 5,732,914 | A | 3/1998 | Flinn | |
| 5,758,972 | A * | 6/1998 | Mack et al. | 5/503.1 |
| 5,787,530 | A | 8/1998 | Brix | |
| 5,872,702 | A | 2/1999 | Kopel | |
| 6,233,765 | B1 | 5/2001 | Verhulst | |
| 6,375,144 | B1 | 4/2002 | Lacey | |
| 6,848,132 | B1 | 2/2005 | Dale | |
| 2002/0018601 | A1 | 2/2002 | Nelson | |
| 2004/0261175 | A1 * | 12/2004 | May | 5/503.1 |
| 2006/0206978 | A1 * | 9/2006 | Hilton et al. | 2/104 |
| 2009/0113631 | A1 * | 5/2009 | Palmer | 5/503.1 |

* cited by examiner

*Primary Examiner* — Robert G Santos
*Assistant Examiner* — Brittany M Wilson
(74) *Attorney, Agent, or Firm* — Albert Haegele; Leyendecker & Lemire, LLC

(57) ABSTRACT

A furniture attachment system is described. Embodiments of the furniture attachment system comprise a highly adjustable interface that is readily adapted to hold, store, or secure items of highly varied size and shape at a convenient location proximate a bed or other piece of furniture. In use, the present invention holds, stores, or secures items at beside, or beside other furniture, by securing the items to a bed or other furniture.

18 Claims, 5 Drawing Sheets

FURNITURE ATTACHMENT SYSTEM AND METHODS OF USE

FIELD OF THE INVENTION

The present invention relates generally to devices for holding, storing, or securing items at bedside, or proximate a chair, sofa, or other furniture.

BACKGROUND

It is sometimes desirable to hold, store, or secure items proximate a bed, chair, sofa, or other furniture. Users often prefer to keep items at beside in order to have the items conveniently located close at hand, but out of the way, i.e. not in the bed with the user. Items that one may desire to keep close to a bed or other furniture include reading glasses, flashlights, firearms, beverage containers, sex accessories, cellular or portable telephones, and remote controls for electronic devices. It may also be desirable to secure a lamp or other illuminating device near one's bed. It is also sometimes advantageous to locate a table, tray, or other substantially flat surface above the surface of a bed, so that a user may place items such as food, beverage, reading material, or a laptop computer on the flat surface at a convenient location for use by an occupant lying or sitting up in bed.

Existing devices for securing or storing items at beside are limited in the range of sizes or shapes of items that a single device can hold, store, or secure. For example, a device configured to hold a flashlight is likely poorly adapted to hold a rifle, cellular phone, or handgun. Similarly, a device configured to hold a handgun is likely poorly adapted to secure a lamp. Existing devices lack adjustability that would allow them to hold, store, or secure items of highly varied size or shape.

DETAILED DESCRIPTION

Figure 1A:
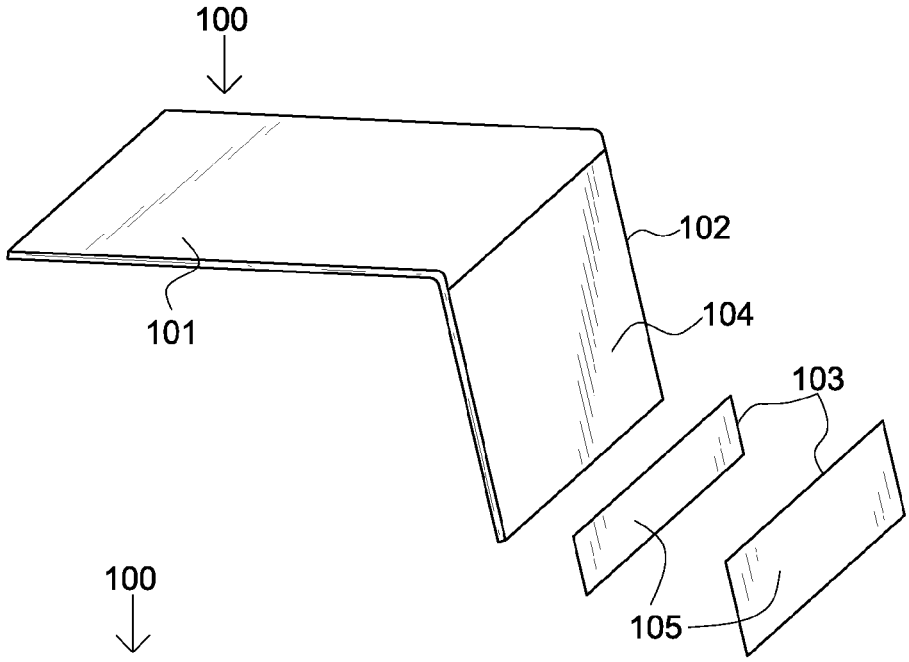
FIG. 1A is an isometric, diagonal view of a furniture attachment system according to one embodiment of the present invention.

Embodiments of the present invention include furniture attachment systems comprising highly adjustable interfaces.

Embodiments of highly adjustable interfaces comprise first interface members that adhere to second interface members. In some embodiments, a first interface member is affixed to or suspended from a bed by use of a support member, the support member being coupled to the first interface member. A support member typically, but not necessarily, affixes to or suspends from a bed by extending horizontally above or beneath a mattress, or by affixing to side rails of the bed. Embodiments of support members are adapted to affix to an arm or a chair or sofa, or to readily insert beneath a cushion of a chair or sofa. Other embodiments comprise support members adapted to affix to other furniture such as, but not limited to, TV trays or carts, coffee tables, or end tables. Embodiments include second interface members with diverse sizes and shapes that removably adhere to first interface members, or to other second interface members. Some embodiments have only one first interface member. Other embodiments have multiple first interface members. Variations of second interface members adhere to first interface members, or to other second interface members, one at a time, or more than one at a time. In some embodiments, second interface members with diverse sizes and shapes removably adhere to a single first interface member, or to another second interface member. Embodiments include second interface members that removably adhere, in any of multiple configurations, to one or more first interface members, or one or more second interface members. Variations include highly adjustable interfaces that allow second interface members to be readily and repeatedly removed from and re-affixed to first interface members, or to other second interface members.

Highly adjustable interfaces include, but are not limited to, magnetic systems, hook and loop (HL) attachment systems, adhesive cement or glue systems, or suction cup systems. Accordingly, highly adjustable interface materials include, but are not limited to, hook structures and complementary loop structures, ferrous metal and complementary magnetized compositions, adhesive cement or glue compositions and complementary surfaces to which the adhesive compositions can removably adhere, and suctions cups with complementary, substantially smooth surfaces to which the suction cups can removably adhere. Some embodiments comprise more than one type of highly adjustable interface. In some embodiments, secondary members removably affix to other secondary members by use of highly adjustable interfaces.

Embodiments of the present invention include support members or interface members comprising material such as, but not limited to, metals, metal alloys, polymers, copolymers, composites, wood, fabric, flexible plastic material, leather, and rope or cord.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or," as used in this specification and the appended claims, is not meant to be exclusive; rather the term is inclusive, meaning "either or both".

References in the specification to "one embodiment," "an embodiment," "another embodiment," "a preferred embodiment," "an alternative embodiment," "one variation," "a variation," and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The terms "couple" or "coupled," as used in this specification and the appended claims, refer to indirect or direct connection between the identified elements, components or objects. Often the manner of the coupling will be related specifically to the manner in which the two coupled elements interact.

The terms "hook and loop," "hook and loop material," "HLM," "hook and loop attachment system," or "HL," as used in this specification and the appended claims, refers to material that typically comprises two complementary structures, a hook structure and a loop structure. Disposed on a hook structure is a plethora of small plastic hooks, adapted to engage with a complementary loop structure on which many small plastic loops reside. As is well known to persons of ordinary skill in the art, engaged hooks and loops provide adhesion and resist being separated, but can be separated and re-engaged repeatedly without substantially reducing their capacity to engage and adhere. Velcro® is an example of hook and loop material.

The term "highly adjustable interface," as used in this specification and the appended claims, refers to structures comprising first interface members and second interface members, or multiple second interface members. Second interface members are adapted to be adjusted to form loops of different shapes and sizes. For example, embodiments of a highly adjustable interface comprise second interface members that are configured to removably adhere to a first interface member to form an approximately 1 inch diameter loop aperture suitable for holding a small flashlight, then adjusted to form an approximately 1"×2" loop aperture suitable for holding a cellular telephone, and then adjusted again to form an approximately 1.5"×4" inch loop aperture suitable for securing, or partially securing, a handgun. In some embodiments, a highly adjustable interface comprises a second interface member that is substantially planar, and is adapted to removably adhere to a first interface member in any of various orientations. Some embodiments of highly adjustable interfaces comprise other second interface members that removably adhere to second interface members. Typically, a highly adjustable interface comprises two complementary mating surfaces that adhere to one another, and that can be readily separated from each other and re-attached, repeatedly.

The term "loop aperture," as used in this specification and the appended claims, refers to an opening formed in a highly adjustable interface through which a portion of an item may pass such that the item is held, stored, or secured by the loop aperture. For example, a loop aperture may be formed in an embodiment of a highly adjustable interface comprising HLM by affixing the ends of a flexible, rectangular, second interface member to a substantially planar first interface member, without the middle portion of the second interface member being in contact with the first interface member. Accordingly, the middle portion of the second interface member that does not directly adhere to the substantially planar first interface member forms a loop aperture.

The terms "bedside" or "side of a bed," as used in this specification and the appended claims, refers to a position proximate a side or end of a bed. Typically, but not necessarily, at bedside refers to a position neither above the top surface nor below the bottom of a bed.

The term "bed rail," as used in this specification and the appended claims, refers to a bed component that is disposed substantially horizontally along a side or end of a bed. Bunk beds and water beds typically have bed rails along the sides or ends of the bed that are disposed at approximately the level of the mattress, and that serve to secure the mattress horizontally. Some hospital or convalescent beds have bed rails that run along the side of the bed, and that can be vertically adjusted above mattress level keep a patient from falling out of bed, or at or below mattress level to allow a patient to get in or out of bed.

The term "mattress supporting structure," as used in this specification and the appended claims, refers to a structure that resides below a mattress to a bed, and on which the mattress rests. A box spring is a typical mattress supporting structure. In some beds, such as platform beds, mattress supporting structures are platforms other than box springs. Platforms and other structures that support water bed mattresses are also mattress supporting structures. A platform is typically, but not necessarily, a substantially rigid planar structure such as a sheet of plywood or medium density fiberboard. Bed slats may also serve as mattress supporting structures. In some applications, a mattress may rest directly on a floor, in which case the floor is a mattress supporting structure.

The terms "ready insertion", "readily insert", or "readily inserted," as used in this specification and the appended claims, refers to placing a support member between a mattress and a mattress supporting structure such as a box spring or platform of a bed. A support member that has been readily inserted does not substantially distort the top surface of the mattress above it. Similarly, a readily inserted support member does not cause a person of average sensitivity to experience discomfort or be otherwise disturbed by the presence of the support member, where the average person is resting on or sleeping on the bed. By necessity, a readily inserted support member is relatively thin along at least one dimension in order to not distort the mattress top surface or disturb the average person while resting on or sleeping on the bed.

The term "mating surface," as used in this specification and the appended claims, refers to a surface of a support member or a first or second interface member, to which a complementary surface of a support member or a first or second interface member is adapted to removably adhere. A mating surface is adapted to removably adhere to a complementary mating surface.

The terms "affix," "affixed," affixes," or "affixing," as used in this specification and the appended claims, refers to being connected with, either directly or indirectly, such that the positions of affixed elements, components, or objects, relative to each other, are either permanently or temporarily fixed.

A First Embodiment Furniture Attachment System

A first embodiment furniture attachment system 100 is illustrated in FIG. 1A. The first embodiment furniture attachment system comprises a support member 101 and a highly adjustable interface, the highly adjustable interface comprising a first interface member 102 and two second interface members 103.

In this embodiment, the support member 101 and the first interface member 102 are each substantially planar, with the plane of the support member disposed at a substantially right angle to the plane of the first interface member. The support member and the first interface member in this embodiment are formed from a single piece of substantially rigid polymethyl methacrylate, with a substantially 90° bend between the support member and the first interface member. Thus the first embodiment furniture attachment system 100 is adapted to hold the plane of the first interface member 102 substantially vertically where the support member 101 is inserted horizontally between a mattress and a box spring of a bed. The second interface members 103 of the first embodiment comprise substantially flexible material that is readily bent, folded, or rolled into a variety of shapes, and are each 1.5 inches wide and 5 inches long when laid flat.

The first embodiment first interface member 102 comprises a first mating surface 104, the first mating surface comprising a hook structure. The second interface members 103 of this embodiment comprise second mating surfaces 105, the second mating surfaces comprising loop structures. The hook structure and the loop structure are complementary in that they are adapted to substantially and removably adhere to each other, together forming hook and loop material familiar to persons of ordinary skill in the art. The structures on which the hook structures and loop structures are disposed could be switched with no loss of function.

Figure 1B:
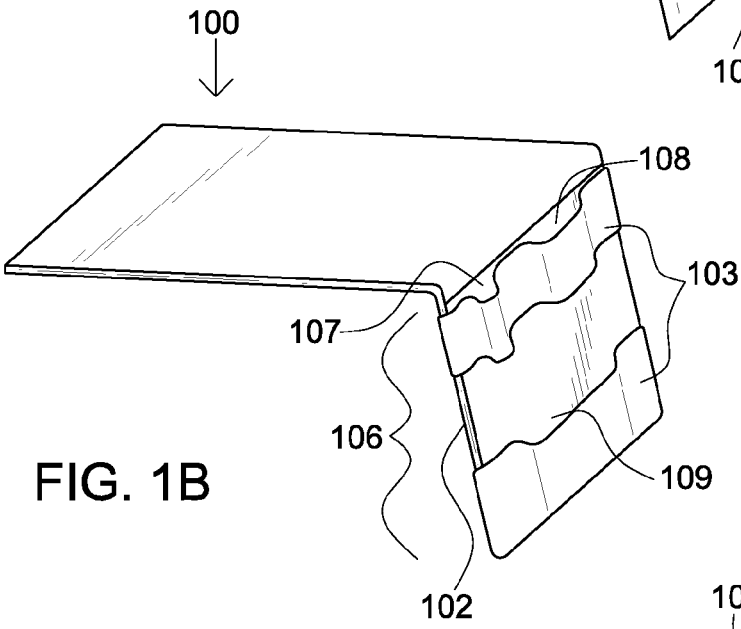
FIG. 1B is an isometric, diagonal view of a furniture attachment system according to one embodiment of the present invention.

The first embodiment furniture attachment system 100 is illustrated in FIG. 1B with a highly adjustable interface 106 intact. The intact highly adjustable interface of the first embodiment comprises second interface members 103 adhering to and disposed on a first interface member 102. The second interface members are configured in FIG. 1B to form a first loop aperture 107, a second loop aperture 108, and a pocket 109. So configured, the first loop aperture is adapted to secure a small flashlight, the second loop aperture is adapted to secure a cellular phone, and the pocket is adapted to secure a small book.

Figure 1C:
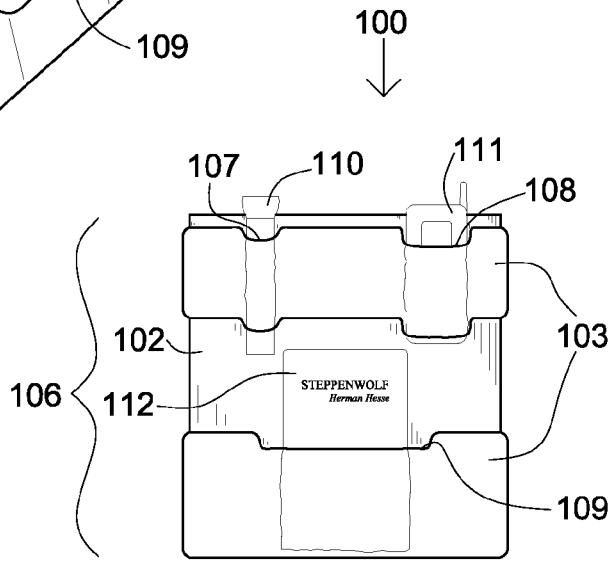
FIG. 1C is an isometric, front view of a furniture attachment system according to one embodiment of the present invention.

FIG. 1C illustrates the first embodiment furniture attachment system 100 viewed head on so that the support member is not visible. The highly adjustable interface 106 of this embodiment, comprising the first interface member 102 and the two second interface members 103, is configured as in FIG. 1B, with a small flashlight 110 secured within the first loop aperture 107, a cellular telephone 111 secured within the second loop aperture 108, and a small paperback book 112 secured within the pocket 109.

The first embodiment furniture attachment system 100 is illustrated in FIGS. 1A, 1B, and 1C with the first interface member 102 projecting downwardly from the substantially horizontal support member 101. The first embodiment furniture attachment system is adapted to be readily configured with the first interface member projecting upwardly, with no loss of function.

Other embodiments of the present invention include planar first interface members disposed at angles other than 90° relative to planar support members. Embodiments include a planar first interface member disposed on substantially the same plane as a planar support member. So disposed, the planar first interface member extends horizontally at a side or end of a bed, where the support member resides inserted beneath a mattress between the mattress and a box spring.

Other embodiments include support members or first interface members comprising substantially flexible material, rather than substantially rigid material. Variations include leather or cloth support members. In some embodiments, a support member lays on top of a mattress. Variations include support members that extend across a substantially entire width or length of a bed. In some variations, two or more first interface members coupled to a single support member reside on opposite sides of a bed, where the single support member is disposed on or under a mattress, across the substantially entire width or length of a bed.

Figure 2A:
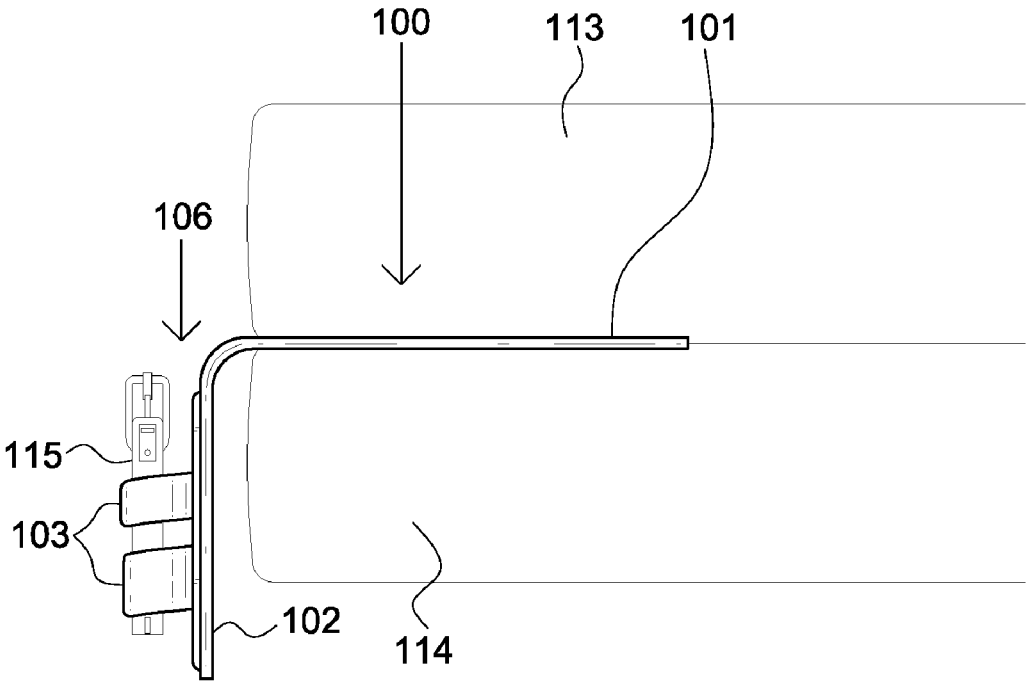
FIG. 2A is an isometric, side view of a furniture attachment system mounted to a bed, according to one embodiment of the present invention.

FIG. 2A illustrates the first embodiment furniture attachment system 100 with the support member 101 disposed between a mattress 113 and a box spring 114 of a bed. The highly adjustable interface 106 comprises a planar first interface member 102 and two second interface members 103. The highly adjustable interface is disposed proximate a side of the bed with the planar first interface member disposed vertically. The second interface members 103 form loop apertures that hold a handgun 115. The first and second interface members of this embodiment comprise complementary mating surfaces of hook and loop material, but the complementary mating surfaces are not identified because they are not easily viewed from this angle.

Figure 2B:
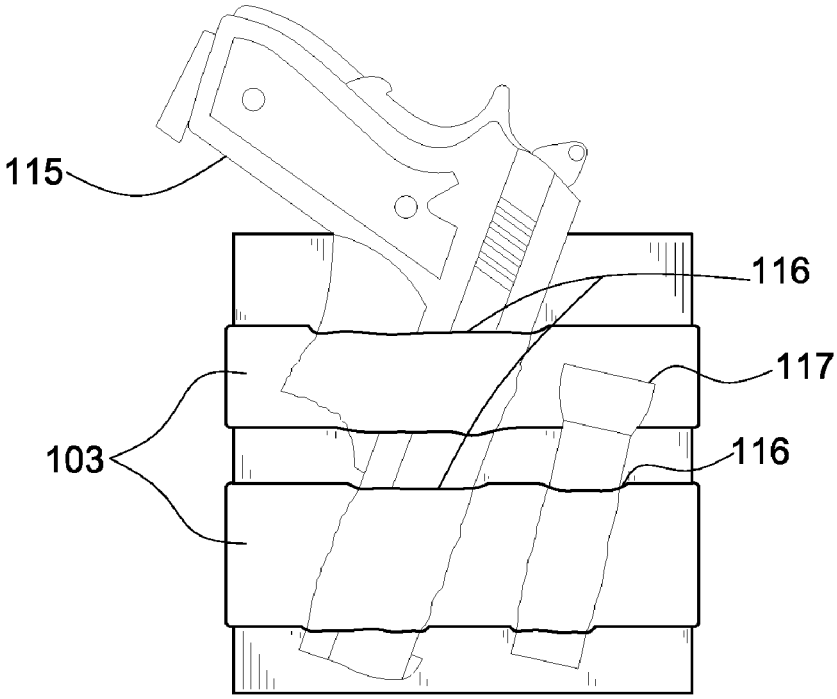
FIG. 2B is an isometric, front view of a furniture attachment system according to one embodiment of the present invention.

FIG. 2B illustrates the first embodiment furniture attachment system viewed head on so that the support member is not visible. The two second interface members 103 in FIG. 2B are configured to form loop apertures 116 into which a handgun 115 and a flashlight 117 have been inserted.

FIGS. 1A, 1B, 1C, 2A, and 2B all illustrate the same embodiment of the present invention, illustrating the adjustability of the system, wherein second interface members are reconfigured to store, secure, or hold items whose size and shape vary substantially. Moreover, various second interface members are interchangeable to interact with the first embodiment first interface member. Embodiments of second interface members are adapted to removably adhere to additional second interface members.

A Second Embodiment Furniture Attachment System

Figure 3:
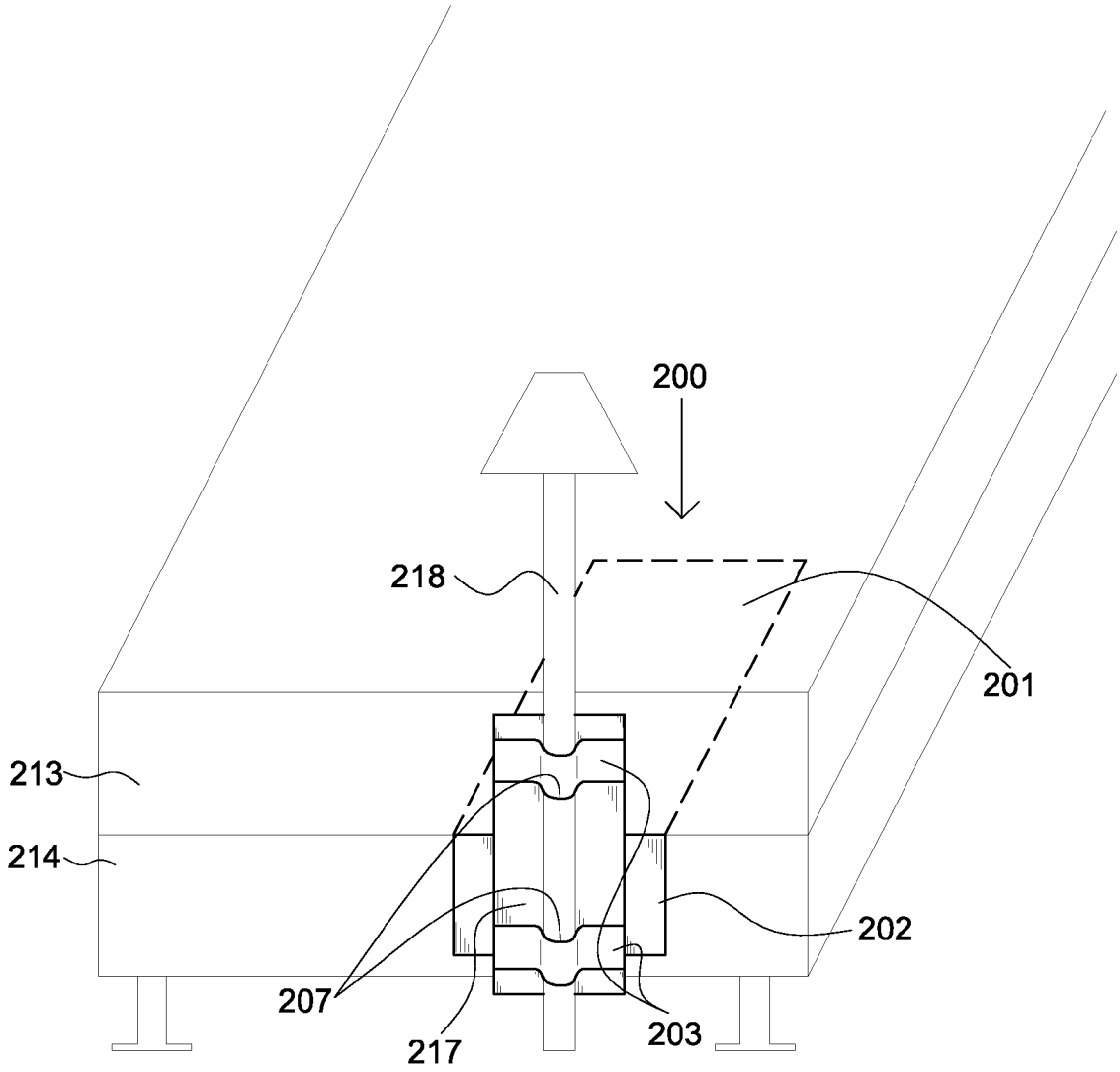
FIG. 3 is an isometric, diagonal view of a furniture attachment system mounted to a bed, according to one embodiment of the present invention.

A second embodiment furniture attachment system 200 is illustrated in FIG. 3. The second embodiment furniture attachment system comprises a support member 201, the support member being disposed between a mattress 213 and a box spring 214 of a bed. A first interface member 202 projects downwardly from an end of the support member at a substantially 90° angle. The support member and first interface member of the second embodiment furniture attachment system comprise substantially rigid material with a substantially 90° bend that delineates the first interface member from the support member. A second interface member 217 resides removably adhered to the first interface member. Other second interface members 203 reside removably adhered to the second interface member 217, the other second interface members forming aperture loops 207 through which a floor lamp 218 extends.

The second interface member 217 adheres to the first interface member 202 through their complementary mating surfaces, which comprise HLM in this embodiment of the present invention. The first and second interface members together form a first highly adjustable interface. The other second interface members 203 also adhere to the second interface member 217 through their complementary mating surfaces, which comprise HLM in the second embodiment. The second and other second interface members form second highly adjustable interfaces.

Floor lamps typically have relatively large bases to stabilize the lamp against toppling over. The large stabilizing bases can interfere with placement of floor lamps. For example, placing a floor lamp between a bed and a wall or between a bed and a nightstand can be made impractical by the large stabilizing base. The second embodiment furniture attachment system provides a means for securing a floor lamp to a bed, thereby abrogating the need for a large stabilizing base, and circumventing placement constraints imposed by the large stabilizing base.

The support member 201 and first interface member 202 of the second embodiment furniture attachment system are substantially similar, if not identical, to the support member 101 and first interface member 102 of the first embodiment furniture attachment system. Likewise, the other second interface members 203 of the second embodiment are substantially similar if not identical to the second interface members 103 of the first embodiment furniture attachment system. Providing the second interface member 217 of the second embodiment enables the system to secure a floor lamp, without a stabilizing base, at bedside. Thus the same furniture attachment system is adapted to secure different sized flashlights, a cellular telephone, a book, a handgun, or a floor lamp, at bedside.

Other embodiments of the present invention comprise a second interface member adapted to holding a rifle. Thus, the same securing and interface member that is adapted to hold or secure the diverse collection of items listed above, is adaptable to hold a rife, by use of appropriate second interface members. The adaptability of the furniture attachment system invention, made possible by the highly adaptable interface, is thus underscored.

A Third Embodiment Furniture Attachment System

Figure 4:
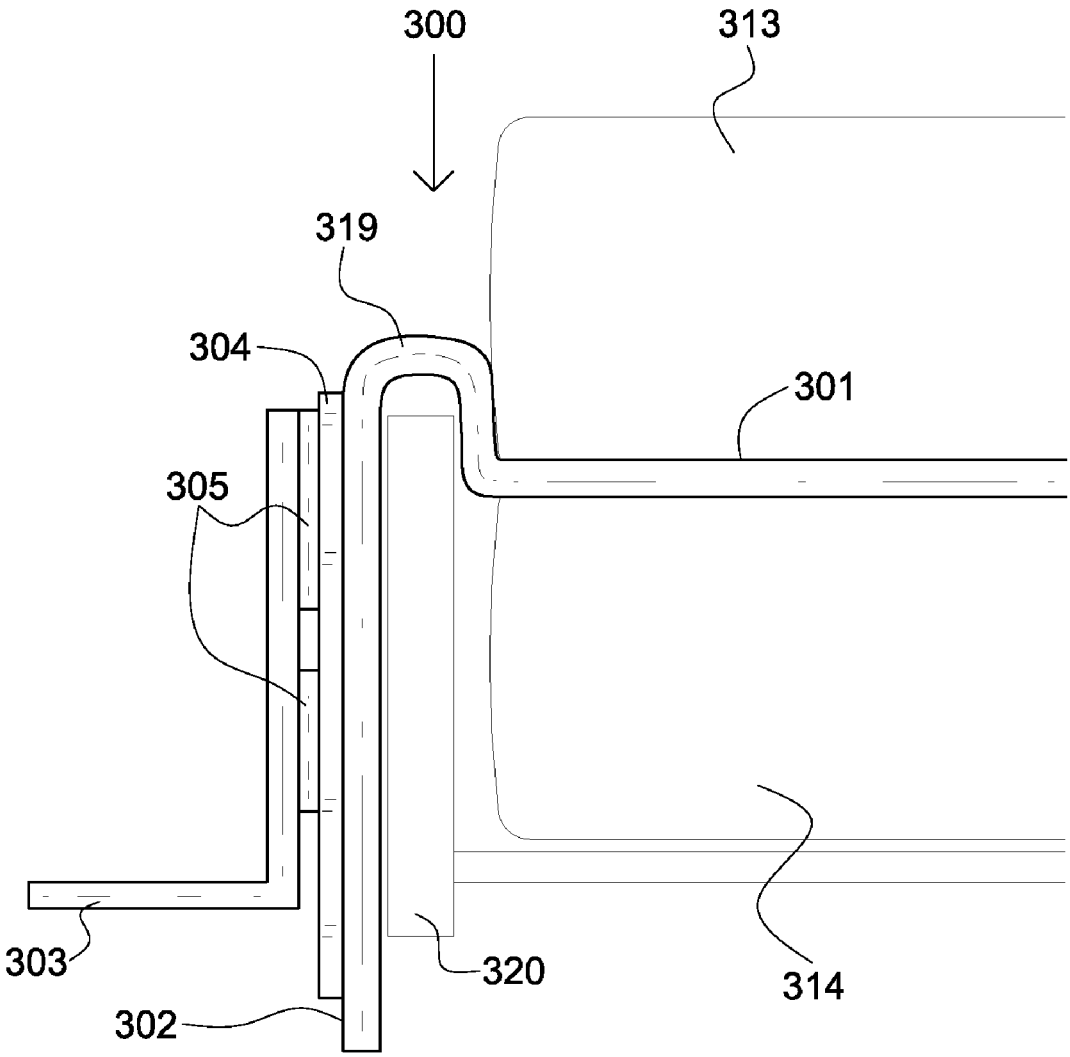
FIG. 4 is an isometric, side view of a furniture attachment system mounted to a bed, according to one embodiment of the present invention.

A third embodiment furniture attachment system 300 is illustrated in FIG. 4. The third embodiment furniture attachment system comprises a substantially rigid first interface member 302 coupled to a support member 301. The support member has a top portion 319 that is curvilinear, the curvilinear top portion being adapted to accommodate a bed rail 320 that extends above the bottom of a mattress 313 of a bed. The first interface member is coupled to a support member 301 that is disposed between the mattress 313 and a box spring 314 to secure the third embodiment furniture attachment system to the bed. The third embodiment top portion of the first interface member is substantially rigid and is shaped to accommodate a bed frame that extends above the bottom of a mattress. In other embodiments, the top portion of the first interface member comprises substantially flexible material that flexes in order to conform to the shape of, and thereby accommodate, a portion of a bed frame that extends above a bottom of a mattress.

The third embodiment furniture attachment system further comprises a second interface member 303, of which second mating surfaces 305 are components. The first interface member of the third embodiment comprises a first mating surface 304 that complements the second mating surfaces. In this embodiment, the first and second interface members in combination make a highly adjustable interface.

The second interface member 303 of the third embodiment furniture attachment system 300 is L shaped, with one arm disposed horizontally where the other arm of the second interface member is installed oriented vertically on a first interface member 302. Among other uses, the horizontal arm of the second interface member is adapted to supporting a beverage container such as a drinking glass or conventional 12 oz can. In some embodiments, an additional second interface member is used to form a loop aperture that secures a vessel such as a beverage container in place on the L shaped second interface member.

The first mating surface 304 and the second mating surfaces 305 of the third embodiment furniture attachment system comprise HLM. The first mating surface 304 of the third embodiment comprises a hook structure. The second mating surfaces 305 of this embodiment comprise loop structures. Thus the hook structure and the loop structure are complementary in that they are adapted to substantially and removably adhere to each other. As is obvious to a person of ordinary skill in the art that the hook structures and loop structures could be interchanged with no loss of function.

A Fourth Embodiment Furniture Attachment System

Figure 5:
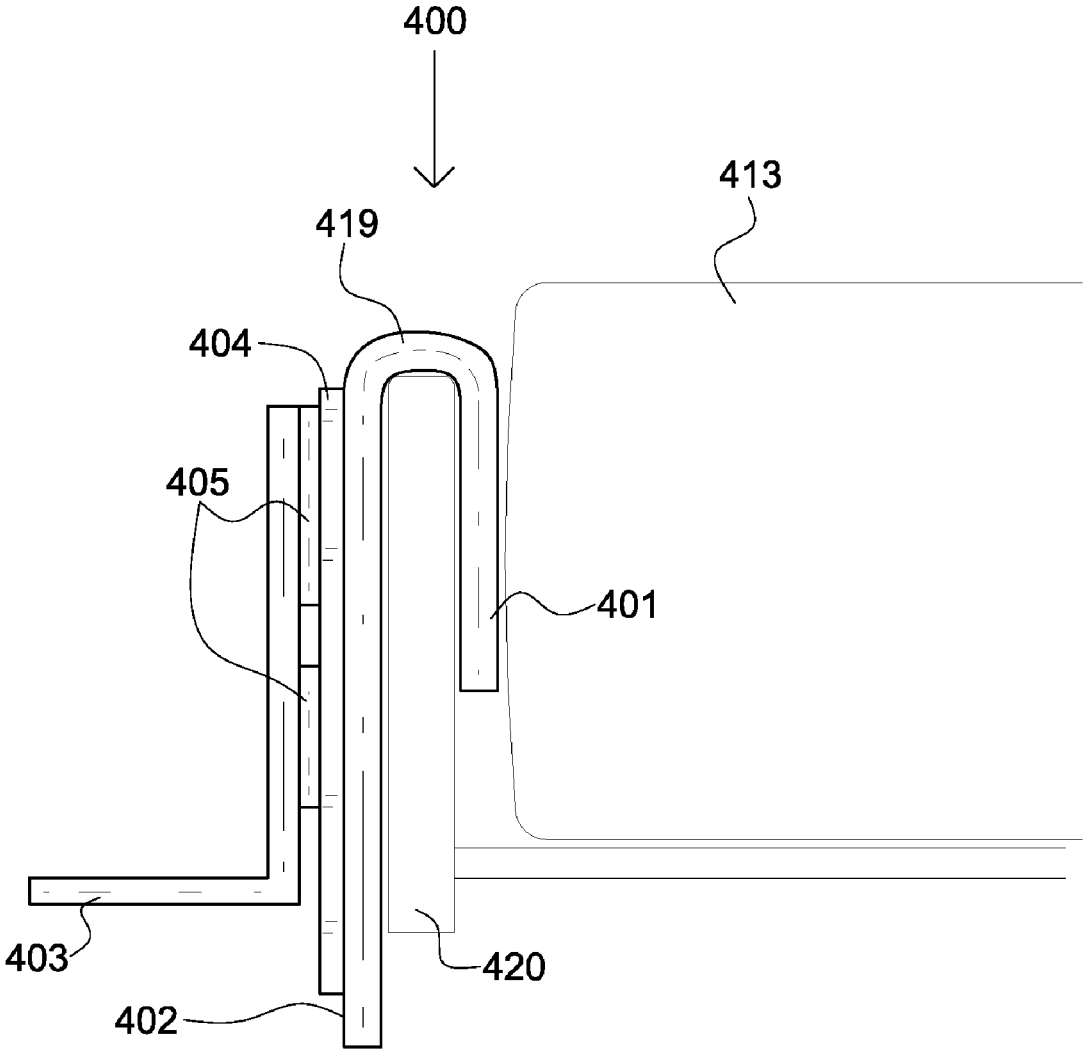
FIG. 5 is an isometric, side view of a furniture attachment system mounted to a bed, according to one embodiment of the present invention.

A fourth embodiment furniture attachment system 400 is illustrated in FIG. 5. The fourth embodiment furniture attachment system comprises a substantially rigid first interface member 402 and a support member 401, the support member having a top portion 419 that is curvilinear. The curvilinear top portion is adapted to accommodate and affix to a bed rail 420, in order to secure the fourth embodiment furniture attachment system to the bed. As illustrated in FIG. 5, the fourth embodiment support member affixes to the bed rail by hooking over the top of the bed rail. A mattress 413 illustrated in FIG. 5 is relatively thick, does not rest on a box spring, and is horizontally constrained by the bed rail 420. This configuration is typical of a water bed. Bed rails are sometimes disposed on hospital beds, and can be embodied as security side rails, or part thereof. Hospital bed rails sometimes comprise two parallel tubes disposed one above the other on a side of a bed. Some embodiments of the present invention are adapted to affix to two over/under parallel tubes of hospital bed rails by use of a support member that hooks substantially around each of the two parallel hospital bed rail tubes. Some support member embodiments are adapted to hook over the top of an upper bed rail, extend between the upper bed rail and a lower, parallel bed rail, and hook under the bottom of the lower bed rail. Some support member embodiments that engage each of two parallel bed rail tubes are "S" shaped.

The fourth embodiment furniture attachment system further comprises a second interface member 403, of which second mating surfaces 405 are components. The first interface member of the fourth embodiment comprises a first mating surface 404 that complements the second mating surfaces. In this embodiment, the first and second interface members in combination make a highly adjustable interface.

The second interface member 403 of the fourth embodiment furniture attachment system 400 is L shaped, with one arm disposed horizontally where the second interface member is installed oriented vertically on a first interface member 402. Among other uses, the horizontal arm of the second interface member is adapted to supporting a beverage container such as a drinking glass or conventional 12 oz can. In some embodiments, an additional second interface member is used to form a loop aperture that secures a vessel such as a beverage container in place on the L shaped second interface member.

ALTERNATIVE EMBODIMENTS AND VARIATIONS

The various embodiments and variations thereof, illustrated in the accompanying figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

For instance, embodiments of the present invention are used to hold, store, or secure items proximate the side or end of a hospital bed, bunk bed, cot, water bed, or recreational vehicle bed. Some embodiments are adapted to hold, store, or secure items proximate a chair, reclining chair, sofa, couch, or love seat. Embodiments comprise support members adapted to affix to a chair or sofa arm, or beneath a chair of sofa cushion. Embodiments are also adapted to affix to a coffee table, end table, TV tray, or mobile cart.

Some embodiments are adapted to hold, store, or secure a hospital table at bedside, such embodiments abrogating the need for the hospital table to have a rolling base familiar to persons of ordinary skill in the art. Embodiments of the present invention adapted to secure a hospital table at bedside do so by securing at bedside, by means substantially similar to the floor lamp in FIG. 3, a vertical member of the hospital table, to which a horizontal table surface adapted to extend over a mattress of a bed is typically attached. Embodiments of the present invention are adapted to secure a rifle. Some embodiments adapted to secure a rifle are also adapted to hold, store, or secure items such as, but not limited to, a book, a handgun, a baseless floor lamp, or a cell phone. This adaptability is achieved in part through the use of highly adjustable interface members comprising an assortment of second interface members adapted to removably adhere to a first interface member or to other second interface members.

We claim:

1. A device comprising:

one or more highly adjustable interfaces, the one or more highly adjustable interfaces comprising:

hook and loop material, the hook and loop material including a hook structure and a loop structure;

a first interface member, the first interface member including a substantially rigid, planar surface, the hook structure or the loop structure residing on the substantially rigid, planar surface;

a second interface member, the second interface member adhering to the first interface member; and a support member, wherein the support member is (i) coupled to the first interface member, and, (ii) adapted to secure the first interface member at bedside by ready insertion between a mattress and a mattress supporting structure, or by attaching to a bed rail.

2. The device of claim 1, wherein the support member is substantially planar, and the first interface member and the support member are disposed in different planes.

3. The device of claim 1, wherein at least one of the one or more highly adjustable interface is adapted to form loop apertures and pockets of varied size and shape.

4. The device of claim 1, wherein at least one of the one or more highly adjustable interfaces comprises a means for forming loop apertures and pockets of varied size and shape.

5. The device of claim 3, wherein:

the substantially planar surface comprises a surface area of at least 25 $in^2$; and the second interface member numbers at least two, each of the at least two second interface members comprising a strip of substantially flexible material at least 1.5 inches wide and at least 5 inches long.

6. A combination comprising:

a bed, the bed comprising a bed rail and a mattress;

a device, the device comprising:

one or more highly adjustable interfaces, the one or more highly adjustable interfaces comprising:

a first interface member;

a second interface member; and a support member, wherein the support member is coupled to the first interface member and affixed to the bed rail.

7. The combination of claim 6, wherein the first interface member comprises a substantially planar surface, the substantially planar surface being disposed substantially vertically.

8. The combination of claim 6, wherein one or more of the one or more highly adjustable interfaces comprises hook and loop material.

9. The combination of claim 8, wherein the one or more of the one or more highly adjustable interfaces is adapted to form loop apertures and pockets of varied size and shape.

10. The combination of claim 7, wherein:

the substantially planar surface comprises a surface area of at least 25 $in^2$;

the first interface member further comprises a first mating surface, the first mating surface being disposed on the substantially planar surface; and the second interface member numbers at least two, each of the at least two second interface members comprising a second mating surface disposed on a strip of substantially flexible material at least 1.5 inches wide and at least 5 inches long, the second mating surface adhering to the first mating surface.

11. A method of securing one or more items at bedside, comprising:

providing a bed, the bed comprising a bed rail, a mattress, and a mattress supporting structure, and;

providing a device, the device comprising:

one or more highly adjustable interfaces, the one or more highly adjustable interfaces comprising:

hook and loop material, the hook and loop material including a hook structure and a loop structure;

a first interface member, the first interface member including a substantially rigid, planar surface, the hook structure or the loop structure residing on the substantially rigid, planar surface; and a second interface member, the second interface member adhering to the first interface member; and a support member, wherein the support member is coupled to the first interface member; and securing the highly adjustable interface at a side of a bed either by (i) inserting the support member between a mattress and a supporting structure, (ii) by laying the support member on top of the mattress, or, (iii) by affixing the support member to the bed rail.

12. The method of claim 11, wherein the first interface member is substantially planar, the plane of the first interface member being disposed vertically.

13. The method of claim 12, wherein at least one of the one or more highly adjustable interfaces comprise hook and loop material.

14. The method of claim 13, further comprising:

configuring the at least one of the one or more highly adjustable interfaces to form a first loop aperture.

15. The method of claim 14, further comprising:

reconfiguring the at least one of the one or more highly adjustable interfaces to form a second loop aperture, the second loop aperture having a substantially different shape than the first loop aperture.

16. The method of claim 14, further comprising:

reconfiguring the at least one of the one or more highly adjustable interfaces to form a second loop aperture, the second loop aperture having a substantially different size than the first loop aperture or pocket.

17. The combination of claim 7, wherein the first interface member is substantially rigid.

18. The combination of claim 17, wherein:

the substantially planar surface comprises a surface area of at least 25 $in^2$ and a first mating surface, the first mating surface being disposed on the substantially planar surface; and the second interface member numbers at least two, each of the at least two second interface members comprising a second mating surface disposed on a strip of substantially flexible material at least 1.5 inches wide and at least 5 inches long, the second mating surface adhering to the first mating surface.

* * * * *